United States Patent [19]

Outman

[11] Patent Number: 4,477,075

[45] Date of Patent: Oct. 16, 1984

[54] PLAYER WORN BALL RETRIEVAL/TRAINING DEVICE

[76] Inventor: J. Frederich L. Outman, 10705 Tesshire Dr., St. Louis, Mo. 63123

[21] Appl. No.: 267,418

[22] Filed: May 26, 1981

[51] Int. Cl.[3] ..... A63B 69/00

[52] U.S. Cl. ..... 273/26 C; 273/55 R

[58] Field of Search ..... 150/2.7, 28 R, 1.7, 150/1.8, 3, 2.2; 229/62, 63; 24/30.5 W, 30.5 P, 204; 128/82; 224/901, 219, 224; 2/DIG. 6, 162; 434/247, 251; 273/55 R, 26 R, 26 C, DIG. 19, 54 B, 414, 67 R, 323, 336, 183 B, 186 R, 190 R, 29 A, 29 R, 191 R, 189 R

[56] References Cited

U.S. PATENT DOCUMENTS

| | | | |
|---|---|---|---|
| 2,603,265 | 7/1952 | Semmes | 150/2 |
| 2,682,290 | 6/1954 | Ditlea | 150/1.7 |
| 3,113,408 | 12/1963 | Kirkpatrick | 229/62 |
| 4,008,851 | 2/1977 | Hirsch | 24/30.5 |
| 4,036,220 | 7/1977 | Bellasalma | 128/82 |
| 4,196,817 | 4/1980 | Moser | 150/2.2 |
| 4,220,333 | 9/1980 | Mercer | 273/54 B |
| 4,254,765 | 3/1981 | Brown et al. | 128/82 |

*Primary Examiner*—Richard C. Pinkham

*Assistant Examiner*—T. Brown

*Attorney, Agent, or Firm*—Haverstock, Garrett & Roberts

[57] ABSTRACT

A player worn training and ball retrieval device comprising an elongated flexible sleeve-like member defining an internal ball retention area and having an end portion with an opening therethrough, the opening being in communication with the ball retention area and being dimensioned to permit a ball and the throwing hand of a user to be inserted therethrough, the end portion having an open ended wristband associated therewith extending along at least a segment of the opening, the wristband including opposite end portions adapted to extend around the wrist of the user, and cooperatively engageable fasteners attached adjacent to the respective opposite ends of the wristband for engaging one another to adjustably secure the device about the wrist of the user, the sleeve-like member adapted to receive a ball and the throwing hand of a user in the ball retention area and to permit the ball to thereafter be gripped and thrown by the user, the ball being retained in the sleeve-like member after each throw and the device remaining secured about the user's wrist.

12 Claims, 5 Drawing Figures

PLAYER WORN BALL RETRIEVAL/TRAINING DEVICE

The present invention relates generally to the area of practice/training devices intended for use by individuals at all levels of pitching and throwing development and, more particularly, to a player worn throwing simulator device adaptable to be easily positioned and comfortably secured around the wrist of the user to assist in developing and improving the proper techniques of throwing a baseball or the like. Although the present device has particular application in assisting a baseball pitcher in developing, improving, and analyzing all skill levels associated with a correct throwing motion, it can also be conveniently utilized for teaching the fundamentals of throwing or refining advanced throwing skills associated with other sports such as softball, football, and other activities involving a throwing motion. The present device can also be effectively incorporated into sports or non-sports related rehabilitation and/or therapy programs.

Development and retention of proper throwing techniques including proper form, motion, and ball delivery techniques is essential to the successful play of a wide variety of sports requiring throwing skills such as baseball, softball and football. It is generally recognized among baseball and softball players that pitching is one of the most important aspects of the game and probably the most difficult player position to effectively master. The ability to throw a baseball or softball with a great deal of accuracy and velocity is of course important for every member of the team, but this ability is perhaps most important for the pitcher since it is the pitcher who controls the pace and tempo of the game and oftentimes determines who will win or lose. In learning how to properly throw a ball, individuals often have difficulty in developing a correct throwing motion including proper ball grip techniques, proper coordination of body movements during the throwing motion, and correct delivery and follow-through techniques. Improper throwing techniques may include a wide variety of errors and/or distortions as compared to the execution of a correct throwing motion. Some very common areas of difficulty involve ball grip and proper wrist flexure during the throwing motion, improper push-off techniques from the pitching mound or other playing surface, improper body form and faulty motion during the throwing motion, improper ball delivery techniques, and the lack of a proper follow-through motion after ball release. These errors cause various undesirable results including loss of control and misdirection of the ball, diminished velocity, and potential injury to the tendons, ligaments and various muscle groups located in the throwing arm. This is particularly important to a pitcher because improper throwing and delivery techniques may substantially curtail the speed and accuracy of the ball thrown thereby diminishing the overall effectiveness and ability of the pitcher to retire the opposing competition, and such improper techniques may seriously jeopardize the longevity of the individual involved.

Consequently, baseball players and other athletes at all levels of skills spend large amounts of time and effort to overcome these deficiencies and continually practice in an effort to increase and advance their level of play and their throwing abilities. Correspondingly, instructors and coaches insist on the development and enhancement of certain fundamental skills through repeated practice of properly demonstrated techniques. Players and coaches alike have had a long felt need for a practice/training device that would enable one to develop those skills while reducing, if not eliminating, the potentiality of developing "bad habits" or other poor throwing skills.

Many different kinds of practice/training devices are known and have been employed for use in developing a wide variety of player skills in sports such as tennis, baseball and golf. Typical of the known baseball training devices is the pitcher's training device disclosed in Starrett et al U.S. Pat. No. 3,888,482 which is specifically designed to teach and develop such skills as the ability to throw a curve ball. The Starrett et al device includes a wristband adjusted to fit securely about the wrist of the wearer and finger engaging means for encircling and interconnecting the base of two spaced fingers on the hand of the wearer to aid the wearer in achieving full wrist flexure during the throwing motion, full wrist flexure being necessary to impart speed and rotation to the ball so as to cause the ball to curve. This device is specifically directed to teaching the proper techniques associated with gripping and throwing a curve ball and is not adaptable to teaching and enhancing the other skill levels associated with a proper throwing motion. Other known baseball training devices are specifically designed to increase one's glove/hand reaction time proficiency in the skills of catching, fielding, and the combination of catch/throw agility, see for examples the devices disclosed in U.S. Pat. Nos. 4,121,824; 3,843,126 and 3,169,019; and still other devices are designed to develop proper batting or golf techniques by teaching a player the proper method of generating a bat or golf swing, see for examples the devices described in U.S. Pat. Nos. 3,870,317; 3,808,707; 3,595,583; 3,429,571; 3,353,824; and 3,346,257. Still further, other known practice/training devices are directed towards improving a player's service technique when playing tennis and such devices typically provide for the indication and correction of improper motion in the course of a tennis serve. Typical of such tennis-related training devices are those described in U.S. Pat. Nos. 4,253,664; 3,997,159; and 3,385,953. None of the known training devices are specifically adaptable for use in teaching, developing, improving and analyzing all aspects of a correct throwing motion including proper form, ball delivery techniques, and the follow-through motion, and none of the prior art devices teach a training device adaptable for related use in other sports involving a throwing motion. For these and other reasons, the known training devices do not achieve the desired objectives and advantages of the present invention as will be hereinafter explained.

The present invention, which satisfies the aforementioned long felt need, is a device that provides the necessary means to advance and refine the throwing skills of any individual and teaches the construction and operation of a relatively simple and inexpensive practice/training device specifically adaptable for use in developing, improving and analyzing all aspects of the throwing motion. The present device includes an elongated, flexible, sock-like or sleeve-like member, preferably made from a lightweight yet durable fabric material, which is adaptable for receiving and holding a ball, such as a baseball, softball or football when positioned therein. The flexible, sleeve-like member is open at one end portion thereof and includes an adjustable open-ended wristband which is attached to the sleeve-like member adjacent to the open end portion thereof. The wristband is likewise preferably made of a relatively soft, flexible yet durable fabric material and extends along the length of the open end portion of the sleeve-like member. Cooperatively engageable fastener means are attached adjacent to the respective opposite ends of the wristband for comfortably attaching and detaching the present device about the wrist of the wearer. With alternative embodiments specifically adaptable for use with a regulation size baseball, softball, or football, the user simply inserts the appropriate ball through the open end portion of the device and thereafter inserts his throwing hand within the flexible, sleevelike member and comfortably yet snugly secures the adjustable wristband around the wrist of the throwing hand. Once the present device is properly secured and positioned on the throwing hand, the user simply grasps the ball within the flexible member and executes a complete throwing motion releasing the ball within the subject device.

Use of the present device enables a user to practice and execute all phases of the throwing motion including body form and particular ball grips and releases unique to the particular sport or activity for which the throwing motion is being practiced. This is accomplished without the aid of an additional player to catch and/or retrieve the thrown ball because the present device immediately retrieves the thrown ball upon release, and it does so without unnaturally restricting or otherwise distorting execution of the throwing motion. Although the overall length of the subject device is not especially critical and can be varied to accommodate particular throwing applications, its length should not be such that it will interfere with the natural throwing motion of the user. Because the present device holds and retains the ball within the flexible, sleeve-like member after ball release, it is particularly adaptable for use in relatively confined areas, both indoors and outdoors, and it can be utilized by players at all levels of skill and development all year round, especially during the off-season, as an aid to improve and maintain their throwing game. In addition, since the present device is preferably constructed totally from fabric materials, it can be relatively easily compacted for ease of handling, storing, and transporting and such a construction facilitates laundering without damage. Additionally, the present device may also be utilized as an effective therapy tool for rehabilitating various injuries to the arm and shoulder.

It is therefore a principal object of the present invention to provide a simple practice/training device adaptable for use in effectively teaching, developing, improving, and analyzing all aspects of an individual's complete throwing motion.

Another object is to provide a practice/training device which immediately retrieves a thrown ball when released without unnaturally restricting or otherwise distorting execution of the throwing motion.

Another object is to provide a practice/training device which can aid in maintaining the conditioning and coordination of an individual's arm and the specific muscle groups utilized therein when throwing.

Another object is to teach the construction of a practice/training device which can be easily positioned over the right or left throwing hand and comfortably yet snugly secured about the wrist of the wearer.

Another object is to provide a practice/training device which is adjustable to accommodate different wrist sizes.

Another object of the present invention is to provide a method and means for enabling an individual to develop and improve his throwing skills without the assistance of others.

Another object is to provide a practice/training device which can be effectively utilized in relatively confined areas, both indoors and outdoors.

Another object is to provide a simple and inexpensive device which can be effectively utilized as a fitness, rehabilitation, therapy, practice, and training aid.

Another object of the present invention is to provide a practice/training device that includes a relatively few number of parts and can be economically produced.

Another object is to teach the construction of a practice/training device which is made entirely of durable fabric materials and can be conveniently laundered without any disassembly and without damage.

Another object is to teach the construction of a practice/training device which can be quickly and conveniently positioned on and removed from the throwing hand of the user.

Another object is to provide a relatively inexpensive practice/training device which is lightweight, durable, and can be easily and conveniently collapsed and compacted for ease of handling, transporting, and storing when not being used.

These and other objects and advantages of the present invention will become apparent to those skilled in the art after considering the following detailed specification which discloses several different embodiments of the subject device in conjunction with the accompanying drawings, wherein.

Figure 1:
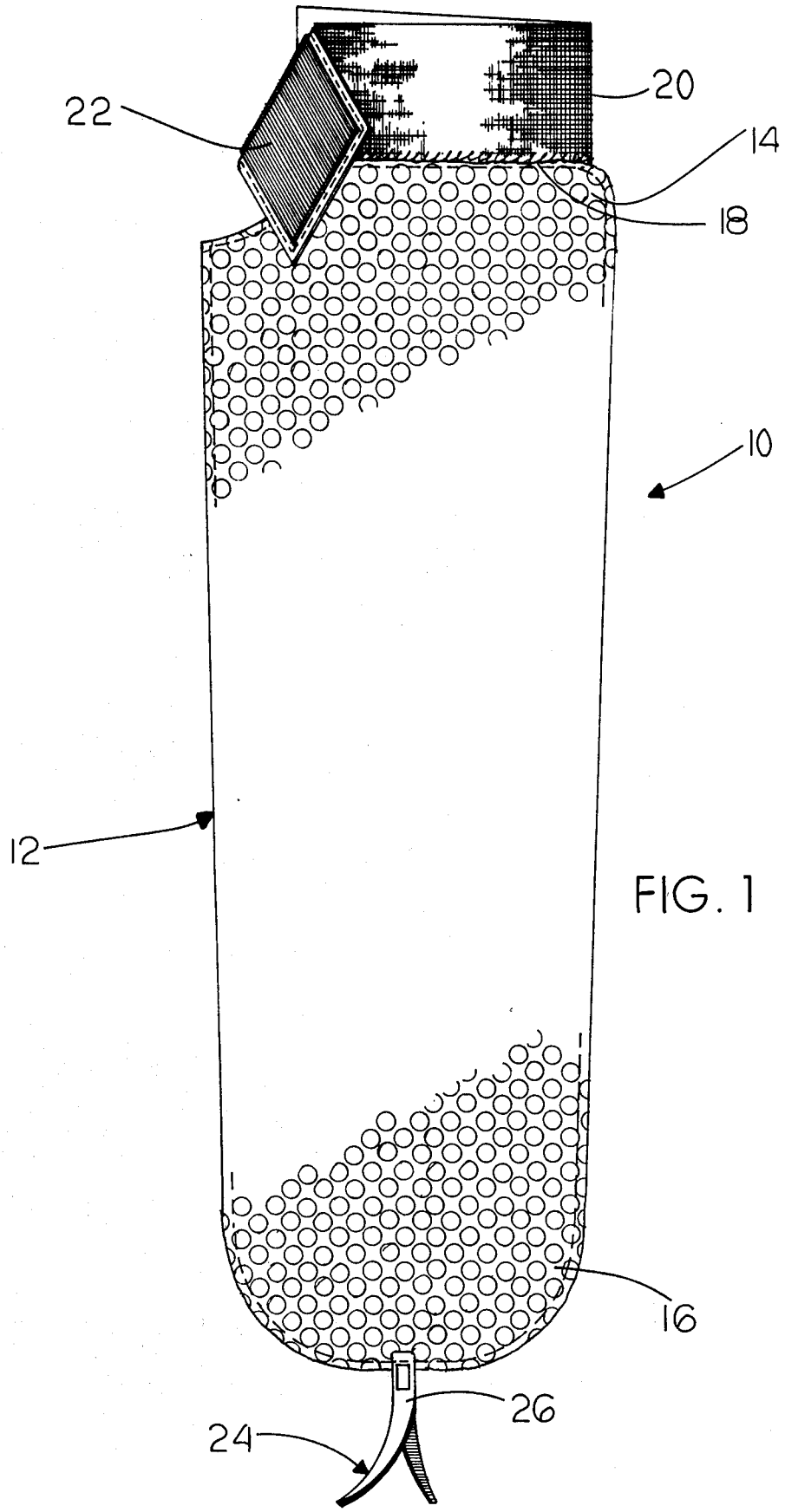
FIG. 1 is a top plan view of one embodiment of the present invention adaptable for use with a baseball showing the wristband and the fastening means associated therewith.
Figure 2:
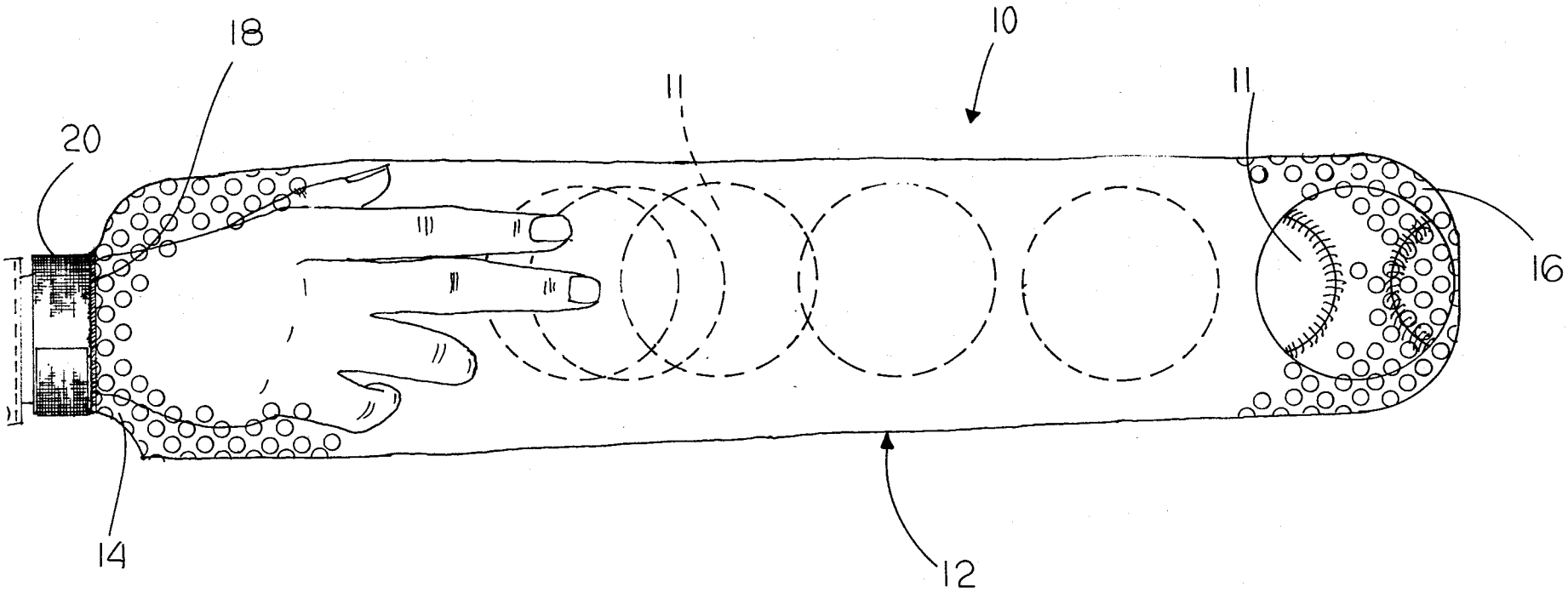
FIG. 2 is a side elevational view of an embodiment similar to the device of FIG. 1 showing the device in operative position secured to the wrist of a user and depicting the trajectory of the baseball after release in dotted outline form.

Referring to the drawings more particularly by reference numbers wherein like numerals refer to like parts, number 10 in FIGS. 1 and 2 identifies one embodiment of the ball retrieval/training device constructed according to the teachings of the present invention. The embodiment 10 is specifically designed for use with a regulation size baseball 11 and includes an elongated, flexible, sock-like or sleeve-like member 12 which is adaptable for receiving and retaining the ball 11 when positioned therein. The elongated member 12 includes end portions 14 and 16 and has a cross-sectional dimension sufficient to permit a baseball to freely and easily traverse the full length thereof when thrown. End portion 14 includes an opening 18 of sufficient size such that both a baseball and the throwing hand of a user may be easily inserted therethrough as will be hereinafter explained. Opposite end portion 16 is completely closed to receive and absorb the impact of a thrown ball thereby stopping and retaining the ball within the member 12 when thrown. The overall length of the flexible member 12 is not especially critical; however, its length should not be so long as to interfere and restrict the natural throwing motion of the user. It has been found that an overall length of between about 1.5 feet to about 2.0 feet achieves the desired objectives for use with a regulation size baseball, although the length of the member 12 may be varied to accommodate particular throwing applications depending upon the size of the ball being positioned therein and the particular sport or other activity for which the throwing motion is being practiced.

It is generally preferred that the elongated flexible member 12 be made from a lightweight yet durable fabric material which is able to withstand the impact and abuse inflicted repeatedly on the end portion 16 by a thrown ball. Although any durable fabric material construction may be utilized, it is also preferred that the durable fabric material be of an open weave type construction such as a heavy-duty flexible nylon mesh since this construction provides the least amount of air resistance as the member 12 moves through the air during the throwing motion. This is desirable because if the member 12 encounters a sufficient amount of air resistance during the throwing motion, this additional resistance may interfere and otherwise restrict execution of the natural throwing motion. The member 12 may be formed of a seamless, one-piece construction, or it may be formed from a single piece of fabric material which is folded over its centerline and secured along both side edges thereof, such as by stitching or by heat searing from an appropriately sized piece of material, to form the member 12 as shown in FIGS. 1 and 2. In addition, the member 12 may also be formed from two or more pieces of fabric material attached together using any known acceptable method. If the member 12 is not of a unitary construction, end portion 16 may be effectively closed by utilizing one of the above-identified methods or by utilizing any other suitable means, including use of a draw-string arrangement, so long as the closed end portion 16 is capable of withstanding the impact and force repeatedly inflicted by a thrown ball. Additionally, it is also anticipated that end portion 16 may be suitably reinforced by any suitable means to add additional strength and rigidity thereto.

An adjustable open-ended wristband 20 positioned adjacent to the open end portion 14 of the flexible member 12 extends along at least a portion of the length of the opening 18 and includes opposite end portions which extend around and overlap to encircle the wrist of the wearer when the device is being worn. Similar to the flexible member 12, the wristband 20 is preferably made of relatively soft, flexible yet durable fabric material and may be integrally formed with the member 12 or it may be attached to the member 12 by any suitable means such as by stitching or by using a heat searing process. The wristband 20 is easily adjustable to accommodate different wrist sizes and includes cooperatively engageable fastening means attached adjacent to the respective opposite ends thereof for comfortably attaching and detaching the present device about the wrist of the wearer. One type of adjustable fastening means may include Velcro fastener strips, such as the Velcro strip 22 (FIG. 1), attached adjacent to each end portion of the wristband 20 and positioned so as to overlap each other to make the necessary connection. Alternatively, one end portion of the wristband 20 could be provided with a buckle and a hook adapted to engage a desired one of a plurality of spaced eyelets near the other end portion of the wristband for attaching it around the wrist of the wearer. Other types of known fastening means such as mating snap fasteners and the like may also be utilized.

The adjustable wristband 20 allows the user greater flexibility to manipulate the size and position of the wristband so as to provide maximum comfort and support. The use of a relatively soft, flexible, fabric material in conjunction with the adjustability and stretchability of the wristband provides for a comfortable, close-fitting engagement with the wrist of the wearer and prevents friction burn, chafing, and other discomforts and/or irritations. In addition, besides being flexible, the wristband 20 may also optionally be somewhat elastic, although this is not essential. In any event, the wristband 20 should be made as easy to position on the throwing hand of the wearer as possible. Additionally, it is especially important to note that the present device utilizes no rigid, non-bendable components, but instead is preferably constructed totally from durable fabric materials. This enables the present device to be easily compressed and compacted for ease of handling and transportation, such as being conveniently carried in one's pocket; it can be conveniently stored or packaged to occupy very little space when not in use; and it can be conveniently laundered in toto even in an automatic washing machine without damage and/or detoriorations.

The embodiment 10 may also optionally include audio feedback means such as the means 24 attached to the member 12 at the center of end portion 16 as shown in FIG. 1. The audio feedback means 24 includes a member such as the tab 26 illustrated in FIG. 1 which produces a snapping or popping sound whenever a user executes a complete throwing motion. It has been found that various audible sounds ranging from a relatively soft, almost undiscernible, snapping sound to a loud, crisp, popping sound may be achieved when the thrown ball impacts end portion 16 of member 12. The loudness of the sound achieved depends upon the particular body form and throwing technique employed, the relatively soft, quiet sound being associated with poor body form and improper throwing techniques and the loud, crisp, popping sound being associated with a correct throwing motion. Use of the audio feedback means such as the member 26 incorporates an additional self-evaluation feature into the present device whereby a user can further critically evaluate his throwing motion based upon the audible sound produced by the member 26 after ball release. It should be noted that the member 26 may be made from a wide variety of acceptable materials such as various known woven fabric or plastic materials, or it could be made from materials such as leather or the like so long as the material utilized is capable of producing a snapping or popping sound as hereinbefore described. In addition, the size and shape of the member 26 may likewise be varied so long as the snapping or popping effect is maintained. Additionally, the flexible member 12 may be somewhat tapered as shown in FIG. 1 so as to channel and guide the thrown ball towards the end portion 16, thereby further enhancing the snapping or popping effect produced.

In preparation for use, the baseball 11 or other appropriate ball is inserted through the opening 18 at end portion 14 of the device 10. The user then simply inserts his throwing hand through the opening 18 and into the flexible, sleeve-like member 12 and thereafter comfortably yet snugly secures the adjustable wristband 20 around the wrist of the throwing hand. Once the present device 10 is properly secured and positioned on the throwing hand as shown in FIG. 2, the user simply grips the ball within the flexible member 12 and executes a complete throwing motion releasing the ball within the subject device. It should be noted that since the ball is not actually thrown a specified distance but only travels the length of the member 12, the natural tendency for a first-time user is to tighten up the muscles in the throwing arm and shoulder thereby substantially restricting the velocity of the ball upon release. This unnatural throwing restriction is usually done in anticipation of the ball striking the end portion 16. This is counterproductive to the very purpose of using the subject device and defeats the advantages and objectives sought therefore, namely, the ability to practice a complete throwing motion including body motion, ball delivery, and follow-through techniques without unnaturally restricting or otherwise distorting the full execution of the throwing motion. The force of the ball striking the end portion 16 of flexible member 12 will cause the user to feel a tug or pull on the throwing arm depending upon the velocity of the ball at release. Nevertheless, the user must learn not to unnaturally restrict his throwing motion in any manner whatsoever and must execute the throwing motion including ball release as in normal play in order to achieve the full advantages and benefits of the subject device. The key to successful use of the present device is to relax and throw the ball as if under game conditions.

The present device is intended for use by all individuals whether professional, amateur, or enthusiast, at all levels of pitching and throwing development. Use of the present device enables a user to practice and execute all phases of the throwing motion including proper ball grip techniques, proper coordination of body movements during the throwing motion, proper ball delivery and release techniques, and proper follow-through techniques. Because the ball is immediately retrieved and retained within the flexible, sleeve-like member 12 after release, the present device 10 is particularly adaptable for use in relatively confined areas, both indoors and outdoors, and its use does not require the aid of an additional player to catch and/or retrieve the thrown ball. This is important because the subject device can be utilized by anyone, regardless of age, without fear of a thrown ball breaking windows, damaging walls, or causing other damage and/or injury to persons and property alike. While the final effect and location of the thrown ball cannot be observed, the subject device does allow the user to practice and perfect all phases of the throwing motion through ease of repetition. Use of the subject device also allows the user to maintain a degree of mid-season form during the off-season and aids in form and motion improvement through self and second party observation and coaching. Its use bridges the gap between the end of one season and the beginning of the next season and greatly assists in maintaining the conditioning and coordination of the specific muscle groups utilized in the throwing arm.

Another important advantage realized through use of the present device, particularly when used in teaching the fundamentals of throwing to a young athlete such as child, is that the inertia and momentum developed by the released ball striking the end 16 of the flexible member 12 causes the user's throwing arm to extend fully after ball release thereby forcing the user to execute a full, smooth, and natural follow-through motion. If the throwing motion and ball release are performed essentially correctly, the subject device reinforces the proper follow-through motion. If, on the other hand, the device seems to pull the user forward and off balance, the user is performing an improper throwing technique. Teaching and developing proper follow-through techniques to a child is a particularly difficult task and use of the present device, through repetition, should facilitate a natural adoption of the proper form and follow-through motion.

Figure 3:
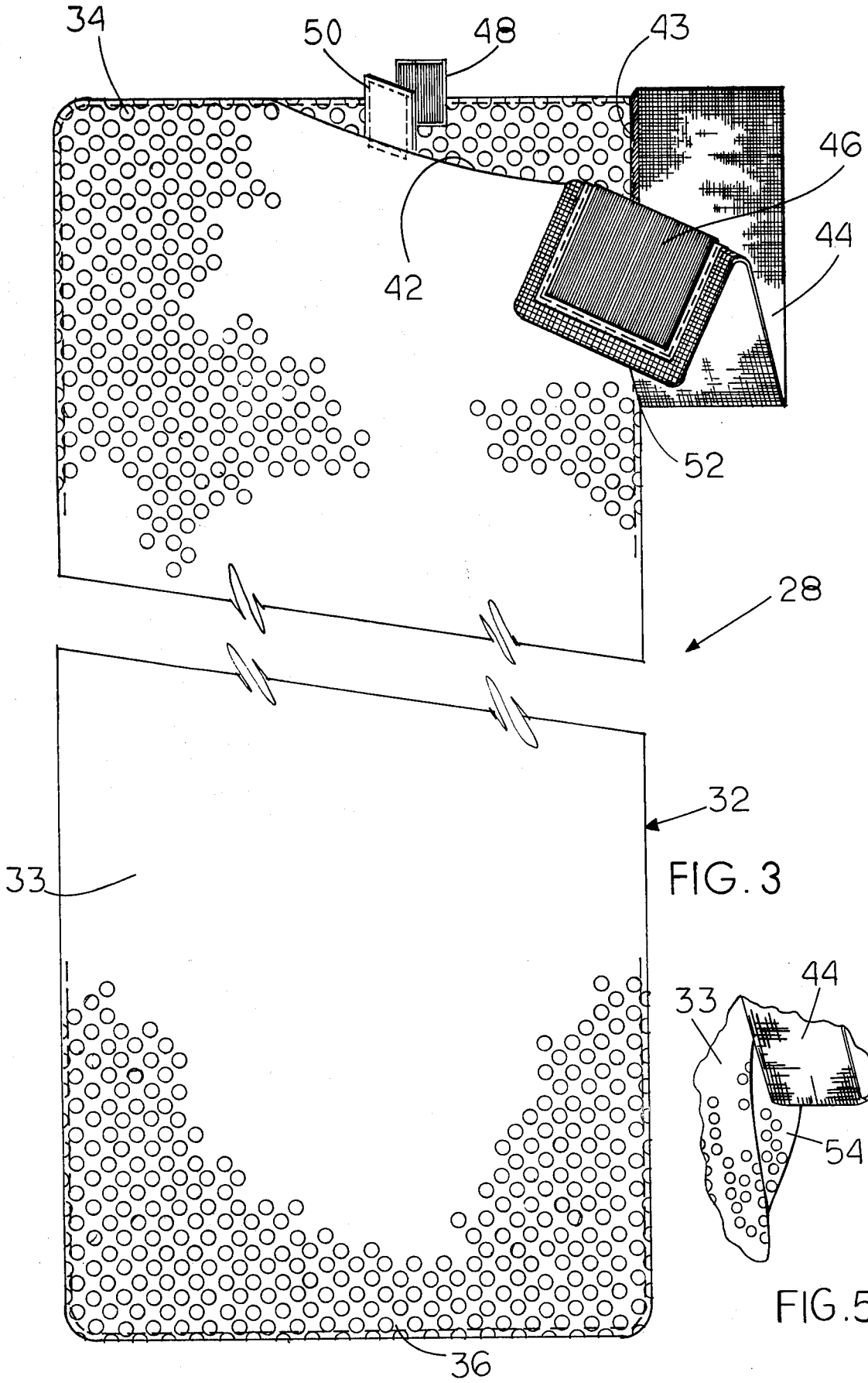
FIG. 3 is a top plan view of another embodiment of the present invention adaptable for use with a football showing the wristband and the fastening means associated therewith.
Figure 4:
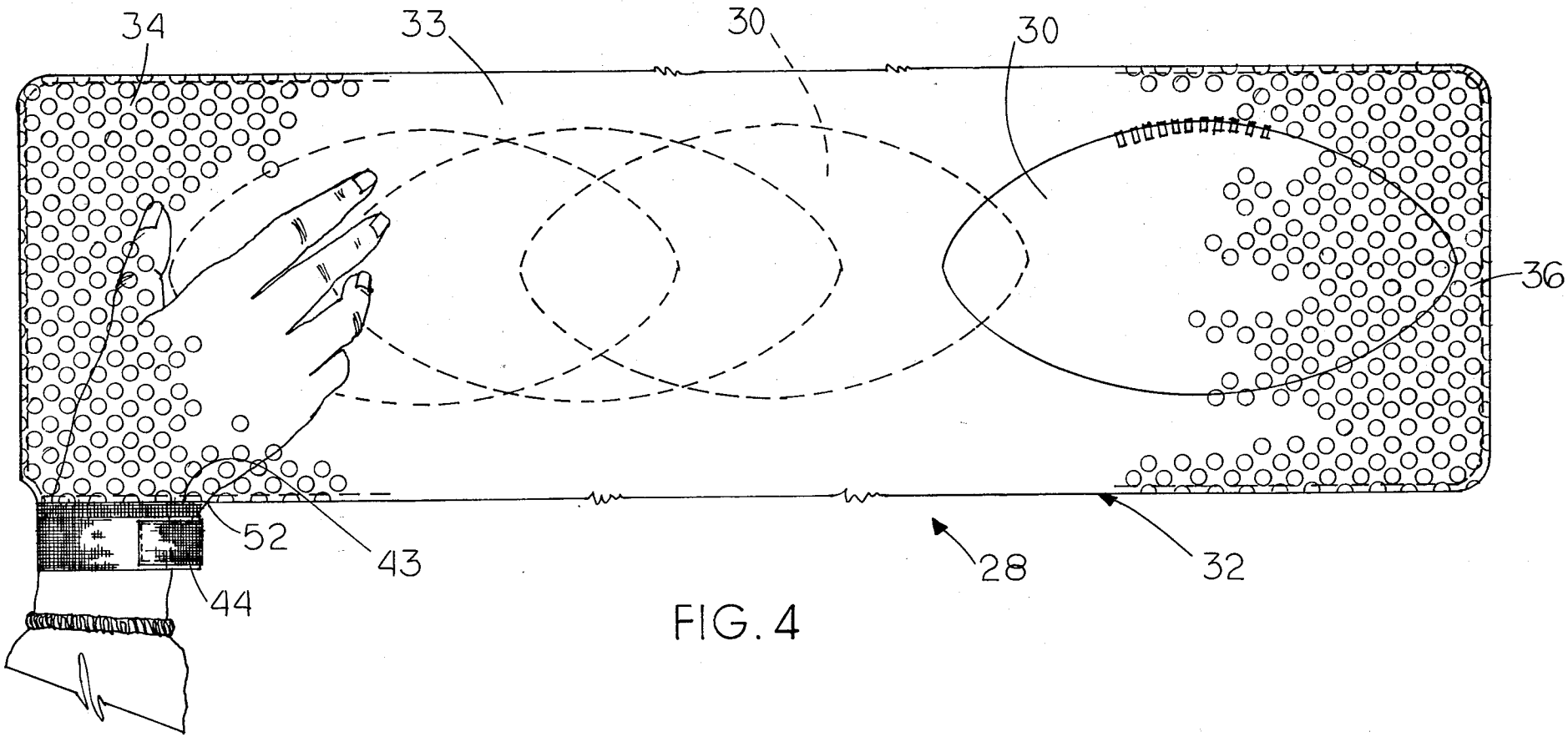
FIG. 4 is a side elevational view of the device of FIG. 3 showing the device in operative position secured to the wrist of a user and depicting the trajectory of the football after release in dotted outline form.

FIGS. 3 and 4 disclose another embodiment 28 of the present ball retrieval/training device which is somewhat similar to the device 10 shown in FIGS. 1 and 2, but is specifically adapted for use with a regulation size football such as the football 30 shown in FIG. 4. The embodiment 28 includes an elongated, flexible member 32 having a sleeve-like body 33 and end portions 34 and 36. The flexible member 32 having a cross-sectional dimension sufficient to permit a football to freely and easily traverse the full length thereof when thrown. End portion 34 includes an opening 42 which extends along a portion of the length thereof as shown in FIG. 3, the opening 42 being of sufficient size such that a football may be easily inserted therethrough. The opening 42 is somewhat different from the opening 18 utilized in the device 10 in that it also includes a portion 43 thereof that opens and extends longitudinally along a portion of the sleeve-like body 33 (FIG. 3) to further facilitate insertion of the ball 30 therethrough and to also provide for insertion of the user's throwing hand as will be hereinafter explained. This arrangement is preferred and desirable when the subject device is to be used with a football since the size of a regulation football is considerably larger than that of a baseball. Like the end portion 16 of the embodiment 10, end portion 36 in embodiment 28 is completely closed to receive and absorb the impact of the thrown ball thereby stopping and retaining the ball within the member 28 when thrown. It has been found that an overall length of the member 28 in the range from about 2.0 feet to about 3.0 feet achieves the desired objectives, although other lengths may be utilized so long as such length does not interfere and restrict the natural throwing motion of the user. Like the flexible member 12, the member 28 is preferably made from a lightweight yet durable fabric material having the characteristics and advantages as hereinbefore discussed. In like manner, the construction of the member 28 including the closure of the end portion 36 may be accomplished by any suitable means including the means hereinbefore discussed with reference to the device 10.

An adjustable open-ended wristband 44 is positioned adjacent to that portion 43 of the opening 42 which extends along the sleeve-like body 33 as shown in FIGS. 3 and 4 and includes opposite end portions which extend around and overlap to encircle the wrist of the wearer when the device is being worn. The positioning of wristband 44 adjacent to the portion 43 of the opening 42 greatly facilitates the natural throwing motion associated with throwing a football and does not unnaturally restrict or otherwise distort the full execution of the throwing motion. Like the wristband 20, the wristband 44 is easily adjustable to accommodate different wrist sizes and includes cooperatively engageable fastening means attached adjacent to the respective opposite ends thereof for comfortably fastening and unfastening the subject device about the wrist of the wearer. Any suitable adjustable fastening means such as the fastening means hereinbefore discussed including the use of overlapping Velcro fastener strips such as the Velcro fastening strip 46 shown in FIG. 3 may be utilized. In addition, the wristband 44, like the wristband 20, is preferably made from a relatively soft, flexible yet durable fabric material having the characteristics and advantages as previously described and it may likewise be integrally formed with the flexible member 32, or it may be attached thereto by any suitable means as explained above. Additionally, since that portion of the opening 42 extending along the end portion 34 is relatively large in order to adequately facilitate the insertion of a football therethrough, additional closing means may be utilized therealong to sufficiently close that portion of the opening 42 once the ball is positioned therethrough and within the member 32. One type of such a closing means may include a pair of cooperatively engageable Velcro fastening tabs such as the tabs 48 and 50 shown in FIG. 3, although any other suitable closing means may likewise be utilized.

In preparation for use, the user simply inserts the football 30 through the opening 42 and thereafter closes that portion of the opening 42 adjacent end portion 34 by securely fastening the closing means associated therewith. The user then inserts his throwing hand through that portion 43 of the opening 42 that extends longitudinally along the sleeve-like body 33 and thereafter comfortably yet snugly secures the adjustable wristband 44 around the wrist of the throwing hand. Once the embodiment 28 is properly secured and positioned on the throwing hand as shown in FIG. 4, the user simply grips the football within the flexible member 32 and executes a complete throwing motion releasing the ball within the subject device. Use of the practice/training device 28 enables a user, such as a football quarterback, to practice and execute all skill levels associated with properly throwing a football including proper footwork and ball release techniques, proper drop back and set up techniques, and proper pass and follow-through techniques. Like the device 10, the device 28 is also particularly adapted for use in relatively confined areas both indoors and outdoors. All of the other objectives and advantages associated with the use of the device 10 are also correspondingly obtainable when using the device 28.

Figure 5:
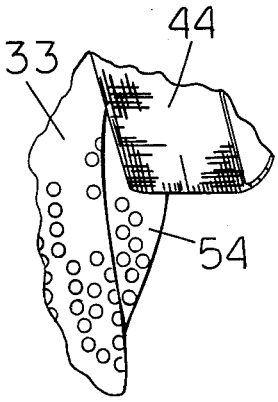
FIG. 5 is a partial perspective view of the embodiment of FIG. 3 showing a modification of the wristband attachment.

In using the subject device 28, it should be noted that when the football 30 strikes the closed end portion 36 of the member 32, the force developed upon impact is transmitted back to the wristband 44 through the sleeve-like body 33. If the wristband 44 is secured to the member 32 at the terminal point 52, a significant portion of the developed force may be absorbed at that point causing a distortion in the natural follow-through motion and may also cause the wristband 44 to chafe and otherwise irritate the skin of the wearer. This problem can be alleviated or minimized by splitting or otherwise cutting an opening or slot 54 in the member 32 starting at 52 and extending longitudinally along the sleeve-like body 33 in a direction away from the wristband 44 as shown in FIG. 5. This will allow the transmitted force generated by ball impact to be dispersed along the sides and back of the wearer's wrist thereby minimizing any distortion effect and substantially reducing the skin chafing problem. An opening or slot 54 several inches in length will generally suffice and provides suitable results.

As hereinbefore discussed, the present invention teaches the construction and operation of a relatively simple and inexpensive practice/training device which can be conveniently and effectively utilized for teaching, developing, improving, and refining the throwing skills associated with a wide variety of sports and other activities. It can be appreciated that the overall length and width of the various embodiments disclosed hereinbefore may be varied to accommodate use of the subject devices with a wide variety of different game balls without departing from the teachings and practice of the invention. Likewise, it is important to note that all embodiments of the present invention may be advantageously employed as a rehabilitation and/or therapy tool for rehabilitating various injuries to the arm and shoulder, or it may be effectively utilized as a fitness aid by anyone who simply wants the exercise of throwing a ball. This increases the usefulness and effectiveness of the present devices.

Thus there has been shown and described several embodiments of a novel ball retrieval/training device for use in teaching and refining throwing skills, which devices fulfill the various objects and advantages sought therefor. Many changes, modifications, variations and other uses and applications of the present constructions will, however, become apparent to those skilled in the art after considering this specification and the accompanying drawings, and all such changes, modifications, variations and other uses and applications which do not depart from the spirit and scope of the invention are deemed to be covered by the invention which is limited only by the claims which follow.

What is claimed is:

1. A player worn practice/training device for use in the overhanded throwing of a baseball, softball or football comprising a strapless elongated flexible sleeve-like member having first and second end portions and an intermediate sleeve-like portion extending therebetween and defining an internal passageway therein between said first and second end portions, said first end portion including an opening therethrough, said elongated member being internally dimensioned to receive therein adjacent said first end portion a ball to be thrown and at least the hand of the player gripping such ball, fastening means associated with said first end portion for removably securing said device to the arm of the player, said second end portion being longitudinally spaced from said first end portion a length sufficient to permit the ball being gripped within such member by a player to be released and to move beyond the player's hand a distance greater than the longitudinal axis of such ball, said intermediate portion having a lateral internal circumference greater than the lateral circumference of such ball and less than essentially twice the lateral circumference of a regulation size baseball, regulation size softball, or regulation size football such that when the player performs an overhanded throw and releases the ball such ball can freely and easily traverse the length of said internal passageway, and means associated with said second end portion to substantially close said passageway to facilitate the stopping and retention of the ball being used therewith when thrown in the device, said device being constructed substantially entirely of a soft lightweight durable material which is foldable for storage in a small space.

2. The practice/training device defined in claim 1 wherein said fastening means includes a wristband adapted to encircle the wrist of the user, said wristband extending along at least a portion of said opening and including means to adjust the effective length thereof.

3. The practice/training device defined in claim 2 wherein said wristband is made of a relatively soft stretchable material for comfortable close fitting engagement with the wrist.

4. A player worn practice/training device for use in the overhanded throwing of a baseball, softball or football comprising an elongated flexible sleeve-like member having a substantially open first end portion, a substantially closed second end portion, an intermediate portion extending therebetween and defining an internal opening between said first and second end portions, and an open ended wristband associated with said first end portion, said wristband being made of a soft material and including opposite end portions adapted to extend around the wrist of the player from opposite directions, and cooperatively engageable fastener means attached adjacent to the respective opposite ends of said wristband for comfortably attaching and detaching said device about the wrist of the player, said elongated member being made of a lightweight durable material and being dimensioned such that the ball being used therewith can freely and easily traverse said internal opening between said first end portion and said second end portion, said internal opening being of sufficient size adjacent said first end portion to receive both the ball to be thrown and the throwing hand of the player gripping such ball when inserted thereinto from said first end portion, said internal opening having a lateral internal circumference throughout the remainder of said intermediate portion greater than the lateral circumference of the ball being used and less than essentially twice the lateral circumference of a regulation size baseball, regulation size softball, or regulation size football, said second end portion being longitudinally spaced from said first end portion a length sufficient to permit the ball being used during the performance of an overhanded throw to move beyond the player's hand a distance greater than the longitudinal axis of such ball and adapted to stop and retain the ball when thrown from said first end portion towards said second end portion, said device being readily foldable and compressible for storage and transport, said device initially hanging limply when secured to the arm of a user who is holding the ball in his hand and thereafter unfurling as the user performs an overhanded throw during which he releases the ball to allow the ball to traverse the length of said internal opening, said device subsequently hanging limply at the conclusion of the user's throw with the ball residing therein adjacent the second end portion of said sleeve-like member.

5. The practice/training device defined in claim 4 wherein said wristband is adjustable to accommodate different wrist sizes.

6. The practice/training device defined in claim 4 wherein said cooperatively engageable fastener means on said wristband include segments of a material on each of said opposite end portions which adhere to one another when engaged.

7. The practice/training device defined in claim 4 wherein the material comprising said elongated member is of an open mesh type.

8. The practice/training device defined in claims 1 or 4 including audio feedback means attached to said second end portion, said feedback means being capable of producing a discernible sound whenever the player wearing the device executes a completed throw of the game ball within the device.

9. The practice/training device defined in claim 8 wherein the sound produced by said audio feedback means varies with the quality of the player's throwing motion.

10. A player worn practice/training device for use in the overhanded throwing of a baseball, softball or football comprising an elongated sock-like member defining an internal ball retention area and having an end portion with an opening therethrough, said opening being in communication with said ball retention area and being dimensioned to permit the ball being used therewith and the throwing hand of a player gripping such ball to be inserted therethrough, said end portion having an open ended wristband associated therewith extending along at least a segment of the opening, said wristband having opposite end portions which extend around the wrist of the player and overlap to encircle the wrist when the device is being worn, cooperatively engageable fastener means attached to the wristband adjacent to the respective opposite ends thereof whereby the fastener means can become cooperatively engaged only when the end portions of said wristband are in the overlapping condition, said elongated sock-like member and said wristband being formed of a relatively flexible yet durable material so as to be foldable and compressible for transport and storage, the length of said sock-like member being sufficient when the device is being worn to permit the ball being gripped within such member by a player to be released and to move beyond the player's hand during the performance of an overhanded throw a distance greater than the longitudinal axis of such ball, said ball retention area having a lateral circumference greater than the ball whereby during the performance of an overhanded throw such ball can freely and easily traverse the length of said ball retention area, said lateral circumference being less than essentially twice the lateral circumference of a regulation size baseball, regulation size softball, or regulation size football.

11. In a player worn device for use in practicing the overhanded throwing of a game ball such as a baseball, softball or football, the improvement comprising a strapless elongated flexible member having a sleeve-like body, said sleeve-like body having a substantially open first end portion, a substantially closed second end portion, and an intermediate portion defining an internal passageway extending the full length between said first and second end portions, said sleeve-like body being unitary in construction and being dimensioned such that the game ball can freely and easily traverse the length of said internal passageway, said internal passageway being of sufficient size adjacent said first end portion to receive both the game ball and the throwing hand of the player when inserted thereinto from said first end portion and having a lateral internal circumference throughout the remainder thereof greater than the lateral circumference of the ball and less than essentially twice the lateral circumference of a regulation size baseball, regulation size softball, or regulation size football, said second portion being adapted to stop and retain the game ball when thrown from said first end portion towards said second end portion, and fastening means associated with said first end portion for removably securing said device about the wrist of the player, said intermediate portion having a length sufficient to permit the ball being gripped within said elongated member by a player to be released during the performance of an overhanded throw and to move beyond the player's hand a distance greater than the longitudinal axis of the ball, said elongated member being made substantially entirely of a lightweight durable open mesh type material, said material being collapsible for storage in a small space.

12. A player worn practice/training device for use in the overhanded throwing of a baseball, softball or football comprising a sheet of soft lightweight durable material having first and second opposite side edge portions, said sheet being folded such that said first and second side edge portions overlay one another and are positioned adjacent one another, means joining said first and second side edge portions to one another, said sheet with said first and second side edge portions so joined to one another defining an elongated sleeve-like member with first and second end portions and an intermediate portion defining an internal passageway extending therethrough between said end portions, said sheet being dimensioned such that the ball being used with the device can freely and easily traverse the length of said internal passageway, the first end portion of said sleeve-like member including an opening therethrough, means associated with the second end portion of said sleeve-like member to substantially close said passageway to facilitate the stopping and retention of the ball being used therewith when thrown in the device, and fastening means associated with said first end portion of said sleeve-like member for removably securing said device to the arm of the player, said device being readily foldable and compressible for storage and transport, said internal passageway being of sufficient size adjacent said first end portion to receive therein both the ball being used therewith and the hand of the player gripping such ball and having a lateral circumference throughout the remainder thereof greater than the lateral circumference of such ball, said lateral circumference being less than essentially twice the lateral circumference of a regulation size baseball, regulation size softball, or regulation size football.

* * * * *